US011338537B2

(12) United States Patent
Hutter et al.

(10) Patent No.: US 11,338,537 B2
(45) Date of Patent: May 24, 2022

(54) METHOD AND APPARATUS FOR TRANSFERRING COMPARTMENTS TO OUTER PACKAGINGS PROVIDED FOR ARTICLES

(71) Applicant: KRONES Aktiengesellschaft, Neutraubling (DE)

(72) Inventors: Alban Hutter, Reit Im Winkl (DE); Wolfgang Fechter, Rosenheim (DE); Markus Prinz, Tuntenhausen (DE)

(73) Assignee: KRONES Aktiengesellschaft, Neutraubling (DE)

( * ) Notice: Subject to any disclaimer, the term of this patent is extended or adjusted under 35 U.S.C. 154(b) by 482 days.

(21) Appl. No.: 16/342,257

(22) PCT Filed: Sep. 20, 2017

(86) PCT No.: PCT/EP2017/073805
§ 371 (c)(1),
(2) Date: Apr. 16, 2019

(87) PCT Pub. No.: WO2018/072955
PCT Pub. Date: Apr. 26, 2018

(65) Prior Publication Data

US 2019/0255797 A1 Aug. 22, 2019

(30) Foreign Application Priority Data

Oct. 20, 2016 (DE) ..... 10 2016 220 642.7

(51) Int. Cl.
*B31B 50/81* (2017.01)
*B31B 120/25* (2017.01)

(52) U.S. Cl.
CPC ..... *B31B 50/81* (2017.08); *B31B 2120/25* (2017.08)

(58) Field of Classification Search
None
See application file for complete search history.

(56) References Cited

U.S. PATENT DOCUMENTS 3,257,002 A * 6/1966 Pearson ..... B31B 50/81 493/312
3,483,802 A * 12/1969 Heyne ..... B31B 50/81 493/91

(Continued)

FOREIGN PATENT DOCUMENTS

DE 202016102814 U1 6/2016
EP 2275350 A3 1/2013

OTHER PUBLICATIONS

German Priority Application: DE 10 2016 220 642.7 filed Oct. 20, 2016—German Search Report dated Jun. 1, 2017.

(Continued)

*Primary Examiner* — Hemant Desai
*Assistant Examiner* — Tanzim Imam
(74) *Attorney, Agent, or Firm* — Simmons Perrine Moyer Bergman PLC

(57) ABSTRACT

The invention relates to an apparatus (1) for transferring compartments (3) to outer packagings that comprises at least one stock of compartments (3), at least one transport path (5) for outer packagings, and a working system that is designed to remove compartments from the stock and that can insert compartments (3) removed from the stock into a respective associated outer packaging. The working system is designed for removing a plurality of compartments (3) from at least one specific stock, for moving the plurality of compartments (3) in the direction of the at least one transport path (5) in a temporally overlapping manner, and for inserting the plurality of compartments (3) into a respective outer packaging of the at least one transport path (5).

11 Claims, 8 Drawing Sheets

(56) References Cited

U.S. PATENT DOCUMENTS

| | | | | |
|---|---|---|---|---|
| 3,803,993 | A * | 4/1974 | Graham | B31B 50/00 493/90 |
| 3,952,633 | A * | 4/1976 | Nakai | B65B 61/207 493/91 |
| 7,302,785 | B2 * | 12/2007 | Heuvel | B31B 50/81 53/157 |
| 9,290,292 | B2 | 3/2016 | Sain | |
| 2013/0274081 | A1 | 10/2013 | Sain | |
| 2016/0107408 | A1 * | 4/2016 | Hutter | B65B 43/305 493/313 |
| 2016/0194104 | A1 * | 7/2016 | Jorissen | B65B 61/207 53/128.1 |

OTHER PUBLICATIONS

PCT Application: PCT/EP2017/073805 Filed Sep. 20, 2017—International Search Report dated Jan. 4, 2018.

PCT Application: PCT/EP2017/073805 Filed Sep. 20, 2017—International Preliminary Report of Patentability from WIP dated May 2, 2019.

* cited by examiner

METHOD AND APPARATUS FOR TRANSFERRING COMPARTMENTS TO OUTER PACKAGINGS PROVIDED FOR ARTICLES

CLAIM OF PRIORITY

The present application claims priority to International Application PCT/EP2017/073805, filed Sep. 20, 2017, which in turn claims priority to German Application DE 10 2016 220 642.7, filed Oct. 20, 2016, which are incorporated by reference.

FIELD OF THE INVENTION

The present invention concerns a method and an apparatus for transferring compartments to outer packagings.

BACKGROUND OF THE INVENTION

The handling of articles often requires individual or several articles to be provided with an outer packaging. This takes place in the case of individual articles for their improved protection and/or for their improved sales presentation. In the case of several articles, the outer packaging also provides a bundle of several articles.

Bundles are an effective way to handle several articles at the same time, for example to facilitate the transport of several articles at the same time. Bundles of several articles held together are therefore the most common variant of sales units for many articles, such as beverage containers.

The articles may, for example, be objects such as packaged or unpackaged objects, receptacles, such as beverage bottles or cans, or even bundles of several objects, whereby the objects of a bundle can, for example, be held together by an enclosure surrounding a group of objects on their periphery, such as a strapping, an outer packaging, such as a wrapping, a shrink tube or a cardboard box or a carrier frame, such as a beverage crate, to name only a few conceivable designs.

The outer packaging used, each containing one or more articles, is, for example, a folding carton, since it provides a high level of protection, possibly additional, for the articles contained therein, is furthermore stackable with the articles contained therein and also enables the articles it contains to be identified by information printed or affixed on its outside. In addition, it can be used as an advertising medium by providing respective information on its outside.

Folding cartons are industrially prefabricated receptacles which are folded or collapsed to a particularly small space or packing size, usually in the form of cuboids, which are transported and stored in a space-saving manner in a collapsed state until they are used, in order to be unfolded into outer packaging when required with simple hand movements or mechanically, as is known, for example, from folding cartons used for postal parcels. When folded, they require little space for transport and storage.

Outer packagings designed as receptacles in the form of folding cartons, for example, may be made with or without compartments, also known as baskets, which are arranged or arrangeable therein, separating and/or keeping apart individual articles.

A compartment is a so-called interior device which is to be arranged or is arranged in an outer packaging and which may, for example, consist of webs which are inserted into one another and/or connected to one another, for example by folding edges and/or adhesive joints.

The webs may, for example, be made of cardboard and/or paperboard or plastics. To protect sensitive items, corrugated board can be used for the webs, for example. The webs are connected and/or are to be connected to each other by folding edges and/or adhesive joints and/or slits in the webs in such a way that partitions with a rectangular, triangular or polygonal base, for example, are created for one or more articles each, in which partitions articles are fixed to prevent them from slipping.

In summary, compartments assign fixed positions to the articles within the outer packaging and thus protect these, for example, from being knocked against each other or rubbed against each other during further transport and/or storage of the outer packaging accommodating the articles until the articles are removed and consumed, which otherwise would lead to a negative impression of the quality by scuffing, for instance, of information applied onto the articles in the form of labels, for example, and/or by the articles damaging each other.

So-called blind compartments or blind cells can be realized at the outer edge of a set of compartments, which can be formed, for example, to be too small for the reception of articles. Blind compartments or blind cells at the periphery of a compartment inserted into an outer packaging or arranged in an outer packaging further protect the articles accommodated in the outer packaging, for example in the instance of mechanical stress and/or deformation of outer packagings accommodating articles.

An outer packaging with compartments, for example, is known from DE 20 2016 102 814 U1. This well-known outer packaging is designed as a receptacle carrier and consists of a cardboard box or a cardboard blank. Furthermore, the receptacle carrier has a polygonal bottom surface and thereon several receptacle holders formed by compartments, a holding section, two parallel longitudinal walls and two parallel end walls, which extend away from the bottom surface.

As with the provision of folding cartons as outer packaging, compartments to be used in outer packagings are preferably prefabricated and folded or collapsed to a particularly small space or bundle size so that they can be transported and stored in a space-saving manner in the collapsed state until they are used, in order to be unfolded with simple hand movements or mechanically when needed.

Compartments and/or outer packagings are preferably made of one-piece or multi-piece cardboard boxes made of stabilized paper grades, such as cardboard and/or paperboard. There are cardboard boxes in various thicknesses and sizes for every type of compartment and/or outer packaging. To protect sensitive items, corrugated board can be used, for example.

Folded or collapsed cardboard boxes which can be unfolded or pulled open to form compartments and/or outer packagings have cardboard box walls which are interconnected by folding edges and/or adhesive joints and/or push-in connections and which may, for example, be cut out and/or punched out of sheet material. When collapsed, at least two interconnected cardboard box walls form an upper and a lower flat side respectively of a flat collapsed cardboard box.

For example, by pressing the sides of a folded cardboard box, it can be unfolded into a compartment and/or outer packaging. It is also possible to hold the collapsed cardboard box on the surfaces of one cardboard box wall respectively, on its upper and lower flat sides, for example by suction cups, and to pull it open by increasing the distance between the surfaces of the cardboard box walls, which is initially limited to the thickness of the collapsed cardboard box.

In the case of an outer packaging in the form of a folding carton, the unfolding or pulling open process creates an interior space and in the case of a foldable and unfoldable compartment or an outer packaging in the form of a folding carton with a compartment already arranged therein, an interior space per pocket of the compartment is created which is accessible through an access opening, or in each instance an access opening, which extends through a plane normal to the carton walls and through which access opening articles can be introduced into the corresponding interior space.

An essential cost factor when handling articles, for example in the food and/or beverage and/or packaging technology and/or in the food and/or beverage and/or packaging industry, is the clocking with which as many articles as possible can be handled as quickly as possible. The higher the clocking, the higher the article turnover and the higher and therefore better the utilization of the machinery, equipment and installations provided for this purpose. The clocking can thus be described as the quotient of the number of articles and the duration within which this number of articles is handled.

In order to achieve a high clocking, fully automatic devices, also known as folding or erecting machines, or folders or erectors for short, are used in packaging technology and in the packaging industry for unfolding and/or pulling open cardboard boxes into compartments and/or outer packagings which, in connection with the provision of folded or collapsed cardboard boxes, remove a folded or collapsed cardboard box from a cardboard box stock within fractions of seconds and pull open and/or unfold it into a compartment and/or outer packaging.

In order to be able to insert a large number of compartments into a large number of outer packagings with the highest possible throughput and short clock times, state-of-the-art devices are already known which have several transport paths, along which the respective outer packagings are moved. In the case of state-of-the-art devices, several compartments are removed from a large number of stocks during one clock cycle and moved in the direction of several outer packagings in order then to be placed in these outer packagings. Such devices have a complex setup and require a large amount of space.

For this reason, one of the tasks of this invention can be considered to be to provide a method and a device for transferring compartments to outer packagings intended for articles, which method and which device require less space than devices and/or methods known from the state of the art and enable compartments to be placed in the respective outer packagings in a simplified manner. In addition, the device and the method are intended to enable the insertion and/or transfer of compartments into respective outer packagings with high throughput and/or high clock times.

The above tasks are solved by a device and a method which include the features in the independent claims. Further advantageous designs are described by the subclaims.

SUMMARY OF THE INVENTION

The invention concerns a method of transferring compartments to outer packagings intended for articles. As part of a step in the process according to the invention, compartments are taken from at least one stock of compartments. The stock of compartments may have a large number of compartments in stacked form and/or may be formed by a large number of compartments in stacked form. The compartments can be folded in the stock and, if necessary, unfolded with and/or during a movement described below in the direction of a transport path described below.

In addition, a plurality of outer packagings are transported and/or moved along at least one and, in preferred embodiments, along at least two transport paths, which are preferably oriented parallel to one another. The at least one transport path can be formed by at least one horizontal conveyor device and/or by at least one circulatingly guided conveyor belt, on which the plurality of outer packagings stand up and are moved along the at least one transport path. The outer packagings may be folded if applicable and unfolded during transport along at least one transport path.

In a further step of the procedure according to the invention, the several compartments taken from the at least one stock are placed in an outer packaging of the at least one transport path assigned to a respective compartment. In particular, it may be provided here that several compartments are introduced simultaneously or at least approximately simultaneously into immediately succeeding and/or immediately adjacent outer packagings of at least one transport path. The several compartments taken from at least one stock can be placed in their respective outer packaging in the direction from above. The several compartments removed from the at least one stock can also be moved at the same speed as their respective outer packaging temporally during insertion into their respective outer packaging.

It is also provided that several compartments are removed from at least one specific stock and that the several compartments removed from a respective stock of the at least one specific stock are moved temporally overlapping in the direction of the at least one transport path and placed in the respective outer packaging. The plurality of compartments can thus be removed from the at least one specific stock, wherein, temporally after removal of all of the plurality of compartments, the plurality of compartments removed from the respective stock of the at least one specific stock are moved together in the direction of the at least one transport path and, after joint movement in the direction of the at least one transport path, are introduced into their respective outer packaging.

By removing several compartments from one and/or at least one respective specific stock, it is possible to transfer several compartments of the specific stock to several outer packagings during one clock cycle. This means that several outer packagings can be loaded with compartments during the respective clock cycle using only one specific stock. The implementation of the process according to the invention thus requires little space and is possible with a high throughput.

In practice, embodiments in which the several compartments are presented in upright orientation via the at least one specific stock have also proved successful. In particular, the several compartments may be provided via the at least one particular stock with a rotationally conforming orientation so that the multiple compartments are received from the at least one particular stock and are not rotated until placed in their respective outer packaging. It may be that the compartments are received in an upright orientation from the at least one particular stock, unfolded temporally after receipt and then placed in their respective outer packaging. The compartments can each provide several receptacles for articles, whereby the receptacles of the compartment are opened upwards as a result of the unfolding of the respective compartment. In particular, it may be the case that the several compartments are not rotated, at least not temporally after removal and/or receipt of at least one particular stock and temporally after unfolding and/or pulling open.

It may also be the case that at least a first compartment is removed from the at least one specific stock and is transferred into a respective specific waiting position, whereupon the at least one first compartment transferred into its specific waiting position and at least one second compartment of the at least one specific stock are moved in the direction of a respective outer packaging in a temporally overlapping manner and are then introduced into their respective outer packaging. In particular, the at least one first compartment may remain motionless in the specified waiting position for a specified period of time and the at least one second compartment may be received from the respective stock of the at least one specified stock. Following this, at least one first compartment can leave its waiting position and be moved together with the at least one second compartment in the direction of the respective outer packaging and placed in the respective outer packaging.

It is conceivable that the at least one first compartment from the at least one specific stock is transferred into its specific waiting position by a swiveling movement about a preferably perpendicularly oriented axis. Insofar as a plurality of first compartments are removed from a respective stock of the at least one specific stock and moved temporally overlapping in the direction of a respective outer packaging and/or the at least one transport path, it may be the case that the plurality of first compartments are transferred to waiting positions situated at a distance from one another, wherein the waiting positions situated at a distance from one another for the plurality of first compartments are adjacent to the respective at least one particular stock on opposite sides.

It is also possible that the at least one second compartment is presented via the at least one specific stock at the time of the at least one first compartment reaching the respective specific waiting position. The at least one second compartment may be formed as a frontmost compartment of the at least one certain stock and/or may be presented as a frontmost compartment of the at least one specific stock.

In addition, embodiments have proved to be successful in which the at least one first compartment in its respective waiting position has a parallel or at least approximately parallel orientation with respect to the at least one second compartment presented via the at least one particular stock. Such embodiments have proved themselves in order to be able to receive the at least one first compartment and the at least one second compartment subsequent thereto and to move them in a simple manner in the direction of their respective outer packaging.

It may also be the case that two first compartments are removed from the at least one specific stock and transferred to a respective waiting position, whereupon the two first compartments and at least one second compartment of the respective at least one specific stock are moved in a temporally overlapping manner in the direction of a respective outer packaging and are then inserted into their respective outer packaging.

In preferred embodiments, a first suction and/or gripping instrument may remove a first compartment from the respective stock of the at least one specific stock and then move away from that respective at least one specific stock. Furthermore, a second suction and/or gripping instrument can, subsequent in time, remove a second compartment from this respective stock of the at least one particular stock, wherein following in a temporally overlapping manner the first suction and/or gripping instrument with its removed first compartment and the second suction and/or gripping instrument with its removed second compartment are moved together in the direction of the at least one transport path and insert their respective removed first and second compartment into the respective outer packaging. The first suction and/or gripping instrument can unfold and/or pull open the first compartment during its movement in the direction of the at least one transport path. Further, the second suction and/or gripping instrument can unfold or pull open the second compartment during its movement in the direction of the at least one transport path.

It may also be the case that a third suction and/or gripping instrument removes a third compartment from a further stock, wherein subsequent in time the first suction and/or gripping instrument as well as the second suction and/or gripping instrument and the third suction and/or gripping instrument are moved in a temporally overlapping manner in the direction of the at least one transport path and insert their respective removed first, second and third compartment into the respective outer packaging.

In practice, embodiments have proved successful in which a removal of the second compartment via the second suction and/or gripping instrument and a removal of the third compartment via the third suction and/or gripping instrument take place simultaneously or at least approximately simultaneously.

The invention furthermore concerns an apparatus for transferring compartments to outer packagings intended for articles. Features which have already been described for various embodiments of the method can also be included in the apparatus described below and are therefore not mentioned redundantly. Furthermore, the characteristics described below concerning the apparatus may be used for the previously described method.

The apparatus for transferring compartments to outer packagings intended for articles comprises at least one provision for a respective stock of compartments. The apparatus further comprises at least one transport path and in particular at least two preferably parallel transport paths for outer packagings as well as a working system or suspension, which is designed for removing compartments from a respective stock of the at least one provision and which can insert compartments removed from a respective stock into a respective associated outer packaging.

For the apparatus in accordance with the invention, it is provided that the working system is designed to remove a plurality of compartments from at least one specific provision, to move in a temporally overlapping manner the plurality of compartments removed from a respective provision of the at least one specific provision in the direction of the at least one transport path and to insert the plurality of compartments removed from a respective provision of the at least one specific provision into a respective outer packaging of the at least one transport path. Insofar as several transport paths are provided, the several transport paths can run parallel to each other and possibly each be formed by a horizontal conveyor device.

In preferred embodiments, it may be provided that the at least one specific provision is designed to present compartments of a respective held stock in upright orientation. Thus, the working system can be designed to receive compartments in upright orientation from the at least one specific provision.

The working system may further include at least one working arm designed to receive at least one first compartment of the at least one specific stock and move it to a respective specific waiting position. The working system can be designed for moving the at least one first compartment as well as of at least one second compartment of the at least one specific provision in a temporally overlapping manner in the direction of a respective outer packaging and for introducing the at least one first compartment and the at least one second compartment into their respective outer packaging.

It is also conceivable that the at least one working arm for receiving and moving the at least one first compartment of the at least one specific stock into a respective specific waiting position can be swiveled about a preferably perpendicularly oriented axis. The at least one working arm can be connected to a servo motor, via which the at least one working arm can be swiveled if necessary. It is also conceivable that the at least one working arm can receive a first compartment pneumatically or via vacuum. In further embodiments, it can be provided that the at least one working arm is designed for clamping and/or mechanical detection of a respective first compartment.

The working system may also include a first suction and/or gripping instrument and a second suction and/or gripping instrument. The first suction and/or gripping instrument may be designed to remove a first compartment from the respective stock of the at least one provision. Furthermore, the second suction and/or gripping instrument may be designed for removing a second compartment from this respective stock of the at least one specific provision. The first suction and/or gripping instrument and the second suction and/or gripping instrument, together with their received first and second compartments, may be designed for moving the first and second compartments in a temporally overlapping manner in the direction of their respective outer packaging and for introducing them into the respective outer packaging. In particular, embodiments have proved successful in which the first suction and/or gripping instrument and the second suction and/or gripping instrument are designed to unfold or pull open their respective received first and/or second compartments.

The first suction and/or gripping instrument can be designed in such a way that it can approach a waiting position temporally after receiving the first compartment and that it remains in the waiting position until receiving and/or removing the second compartment via the second suction and/or gripping instrument. The first suction and/or gripping instrument and the second suction and/or gripping instrument can be connected to a control unit which determines a removal and/or reception of the first compartment and the second compartment via the first suction and/or gripping instrument and the second suction and/or gripping instrument and possibly controls the first suction and/or gripping instrument to approach the waiting position.

In practice, embodiments have also proved to be successful in which the working system comprises a third suction and/or gripping instrument, wherein the third suction and/or gripping instrument is prepared for receiving a third compartment from a stock of a further provision, and wherein the third suction and/or gripping instrument, the second suction and/or gripping instrument and the first suction and/or gripping instrument, together with their received first, second and third compartments, are designed for moving the first, second and third compartments in a temporally overlapping manner in the direction of their respective outer packaging and for introducing them into the respective outer packaging. The first suction and/or gripping instrument, the second suction and/or gripping instrument as well as the third suction and/or gripping instrument can possibly be connected to a control unit which determines the temporally overlapping movement of the first suction and/or gripping instrument, the second suction and/or gripping instrument and the third suction and/or gripping instrument.

Embodiments have proved successful in this respect in which the second suction and/or gripping instrument and the third suction and/or gripping instrument are formed for a time-synchronous or at least approximately time-synchronous removal of the second and third compartments.

BRIEF DESCRIPTION OF THE FIGURES

In the following, embodiments of the invention and their advantages will be explained in more detail using the enclosed figures. The proportions of the individual elements to each other in the figures do not always correspond to the real proportions, since some forms are simplified and other forms are enlarged in relation to other elements for better illustration.

DETAILED DESCRIPTION OF THE INVENTION

Identical reference signs are used for identical or functionally equivalent elements of the invention. Furthermore, for the sake of clarity, only the reference signs required for the description of the respective figure are shown in the individual figures. The embodiments shown are only examples of how the invention can be designed and do not represent a final limitation.

Figure 1:
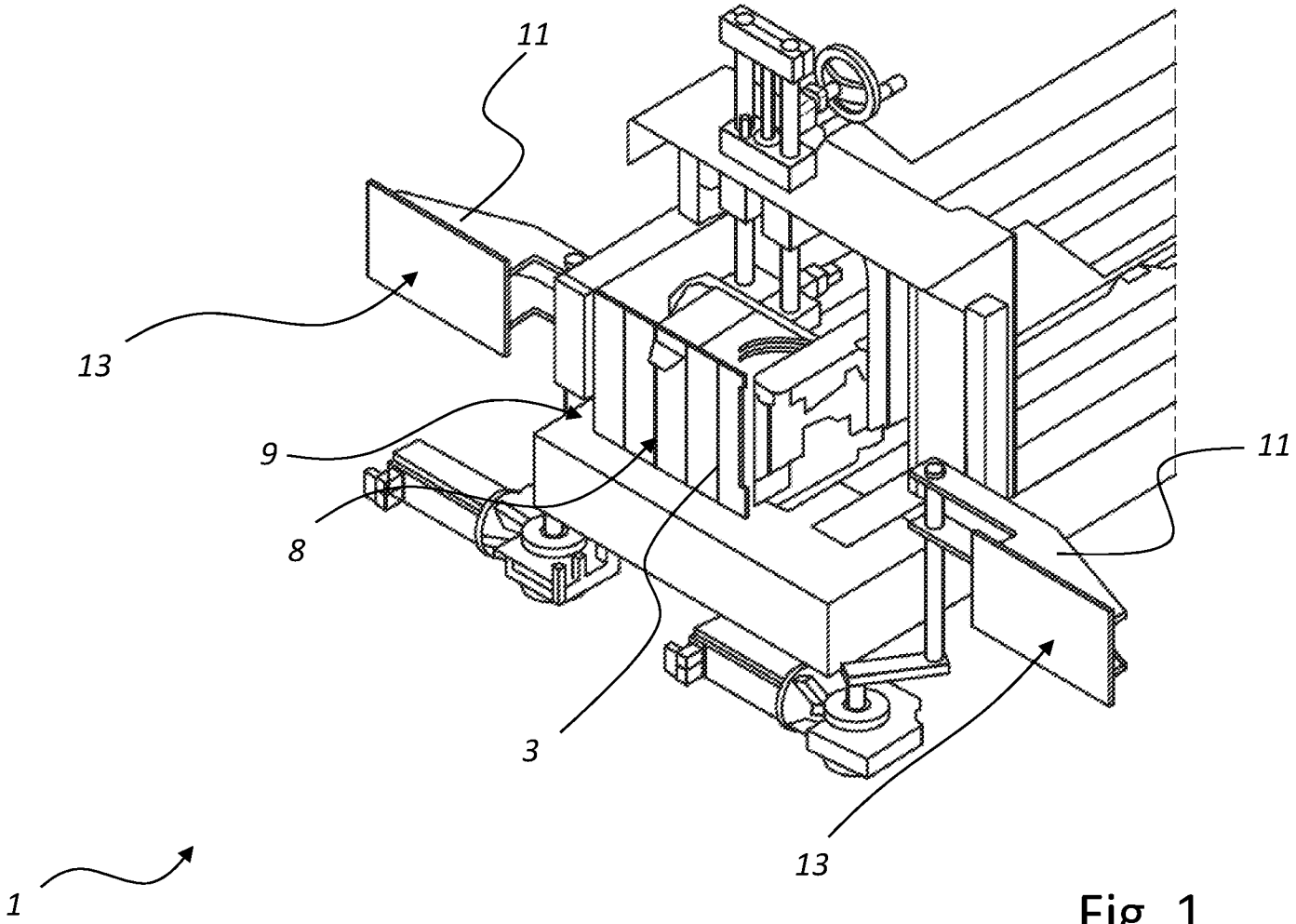
FIG. 1 shows a schematic perspective view of a first embodiment of an inventive apparatus.

FIG. 1 shows a schematic perspective view of a first embodiment of an inventive apparatus 1. The apparatus is designed for transferring compartments 3 to outer packagings intended for articles, wherein the outer packagings are not shown in the figures of this patent application for reasons of clarity. The outer packagings are transported on two parallel transport paths 5, which transport paths 5 are not shown in FIGS. 1 to 4, but are shown in FIG. 5. The outer packagings may, for example, be in the form of a cardboard box or beverage crate, into which a respective compartment 3 for forming pockets intended for beverage receptacles can be inserted by the apparatus 1.

The apparatus 1 comprises a provision 9, which presents a plurality of compartments 3 in upright and stacked orientation. Furthermore, two working arms 11 are visible, which can be swiveled about a perpendicular axis in relation to the provision 9 and which each have a broadside surface 13 in order to receive compartments 3 from the stock 8 of the provision 9 and to transfer them into a waiting position described below. It is conceivable, for example, that the compartments 3 can be secured by applying a vacuum or by mechanical gripping on the respective broadside surface 13 of a respective working arm 11. In the embodiment from FIG. 1, the working arms 11 can be swiveled by a respective servo motor.

Figure 2:
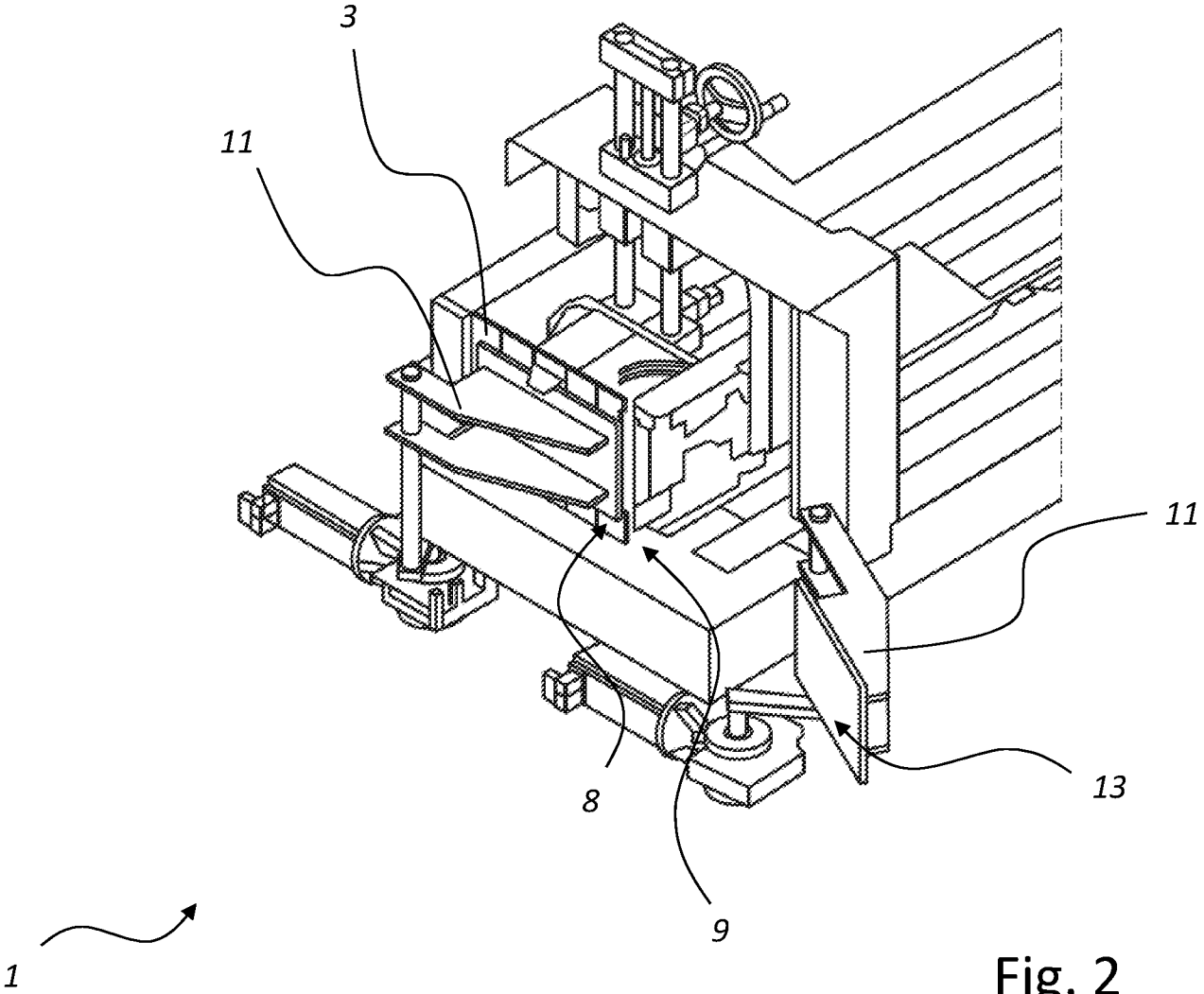
FIGS. 2 to 4 each show a schematic perspective view of the embodiment of an apparatus from FIG. 1 and illustrate individual steps as they can be provided for a conceivable embodiment of the inventive method.
Figure 3:
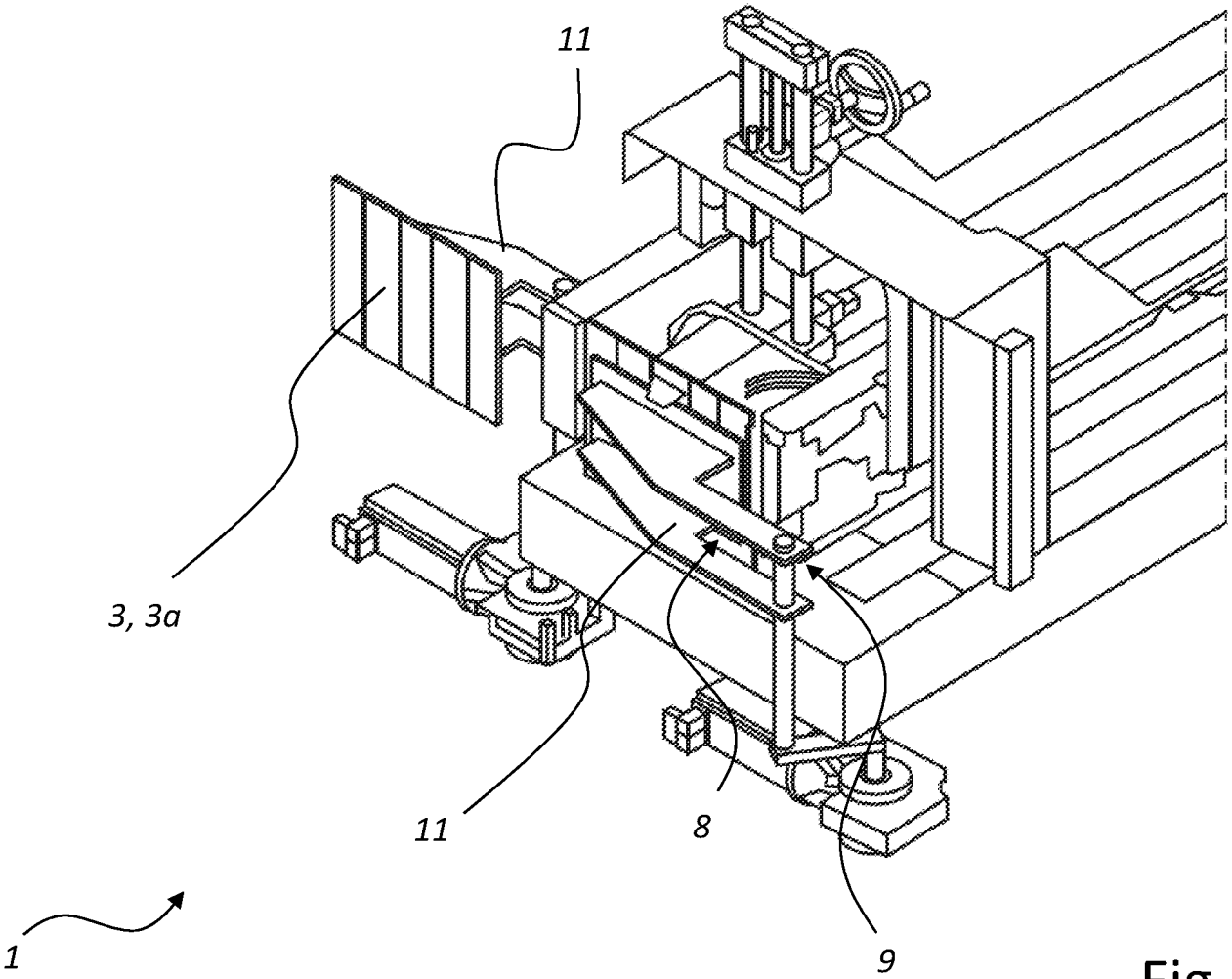
Figure 4:
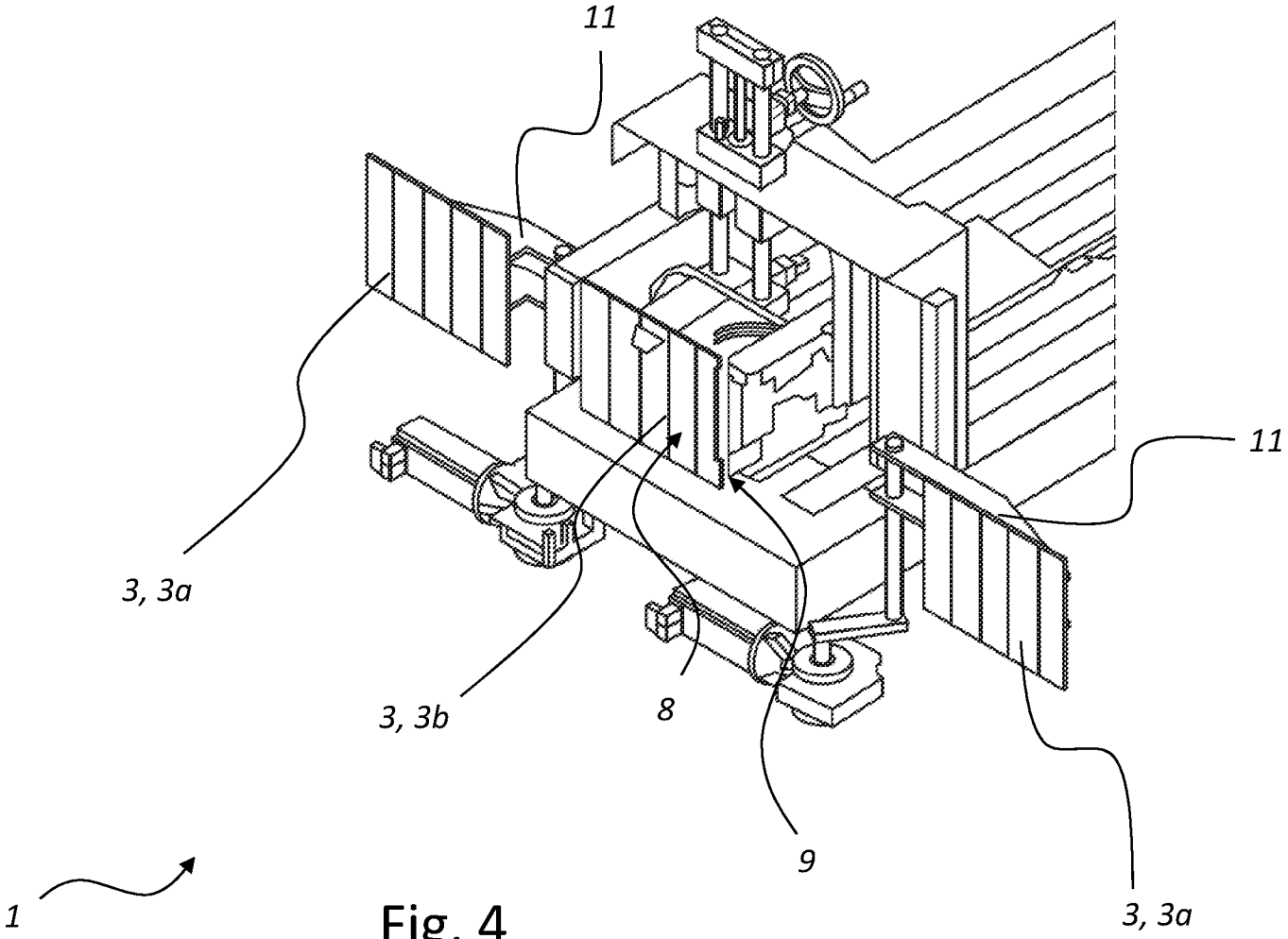
Figure 5:
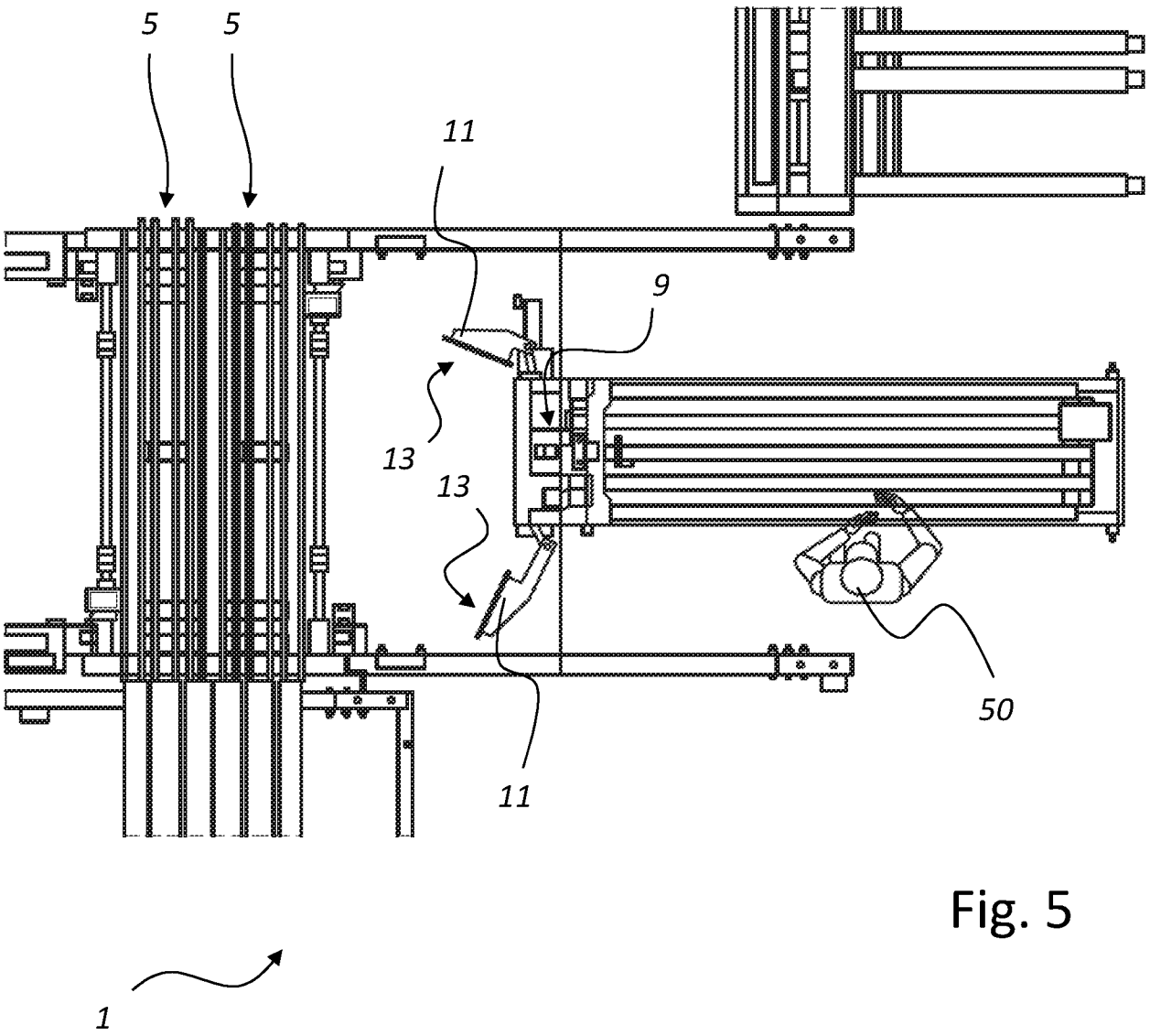
FIG. 5 shows a schematic top view of the embodiment of an apparatus from FIGS. 1 to 4.

FIGS. 2 to 4 each show a schematic perspective view of the embodiment of an apparatus 1 from FIG. 1 and illustrate individual steps as they can be provided in a conceivable embodiment of the inventive method. For example, a look at FIGS. 1 and 2 together shows that the left-hand working arm 11 was swiveled about a perpendicular axis in the direction of provision 9 and/or stock 8 of compartments 3 by an angle of 180°. The broadside surface 13 of the working arm 11 shown on the left, which can still be seen in FIG. 1, is in abutment with a frontmost compartment 3 of the stock 8 in FIG. 2. In addition, the working arm 11 has secured the frontmost compartment 3 on its broadside surface 13. It is conceivable, for example, that a vacuum is created between the working arm 11 and the frontmost compartment 3 in order to secure the frontmost compartment 3 of the provision 9 and/or the stock 8 on the working arm 11.

It may also be the case that the frontmost compartment 3 of the provision 9 and/or stock 8 is seized, for example clampingly or mechanically by the working arm 11, and/or temporarily received.

The working arm 11 shown on the right has already initiated a swiveling movement in FIG. 2 and/or has already been rotated from the position according to FIG. 1 in the direction of provision 9 and/or stock 8, but has not yet reached provision 9 and/or stock 8. A coordinated swivel movement of both working arms 11 can be specified by a control unit if necessary.

In FIG. 3, it can now be seen that the working arm 11 shown on the left, starting from the position from FIG. 2, together with its received compartment 3 and/or a received first compartment 3*a*, has carried out a swiveling movement of 180° in the opposite direction and is in a waiting position in FIG. 3. The position and/or waiting position of the working arm 11 shown on the left from FIG. 3 therefore corresponds to its position and/or orientation according to FIG. 1.

Furthermore, the working arm 11 shown on the right has continued its swivel movement already initiated in FIG. 2 and is now in abutment with its broadside surface 13 (see FIGS. 1 and 2) with a frontmost compartment 3 of the stock 8. The frontmost compartment 3 is secured pneumatically or mechanically on the working arm 11 shown on the right side when the working arm 11 shown on the right side is positioned according to FIG. 3. To achieve the position shown in FIG. 3 starting from the position shown in FIG. 1, the working arm 11 shown on the right was swiveled by a 180° angle of rotation.

FIG. 4 shows that the working arm 11 shown on the right was swiveled back by a 180° angle of rotation to the position shown in FIG. 1 after receiving the compartment 3 and/or another first compartment 3*a*. During the swivel-back movement, the working arm 11 shown on the left together with the received first compartment 3*a* remains stationary in its waiting position already occupied in FIG. 3. The working arm 11 shown on the right has reached an end position in FIG. 4, wherein the first compartments 3*a* and a further compartment 3*b*, which is still formed as part of the stock 8 and/or is arranged in the stock 8, are oriented parallel to one another. By the apparatus 1 according to FIGS. 1 to 4 and/or by the steps described according to FIGS. 1 to 4, it is possible to simultaneously present three compartments 3 with a specific orientation by a provision 9 and/or via a stock 8. The compartments 3 and/or the first two compartments 3*a* and the second compartment 3*b* can be received starting from the position shown in FIG. 4 by a respective working tool, which is not shown, moved synchronously in the direction of a respective outer packaging and inserted into the respective outer packaging. In particular, the three compartments 3 presented in accordance with FIG. 4 can be placed in immediately successive outer packagings of a transport path 5 (see FIG. 5) by the working tools not shown. As an overall view of FIGS. 1 to 4 additionally shows as a whole, the swivel axes for the two working arms 11 and/or for the working arm 11 shown on the right and left are oriented perpendicularly and parallel to each other.

FIG. 5 shows a schematic top view of the embodiment of an apparatus from FIGS. 1 to 4. FIG. 5 shows for the first time the transport paths 5, which move outer packagings in parallel directions and are formed by horizontal conveyor devices arranged parallel to each other.

Furthermore, FIG. 5 shows the provision 9 already shown in FIGS. 1 to 4 respectively as well as the working arms 11 with their broadside surfaces 13. In the area of the apparatus 1, there is also an operator 50, who can manually eliminate malfunctions of the apparatus 1, if necessary, and who controls the operation of the apparatus 1 via a control unit not shown.

FIG. 5 also illustrates that, after receipt, the compartments 3 (see FIGS. 1 to 4) must be moved obliquely and, in particular, perpendicularly to the direction of flow of the outer packagings in order to be introduced into their respective outer packagings moved via the transport paths 5. By such an orientation of the transport paths 5, the space requirement for the apparatus 1 can be kept small.

Figure 6:
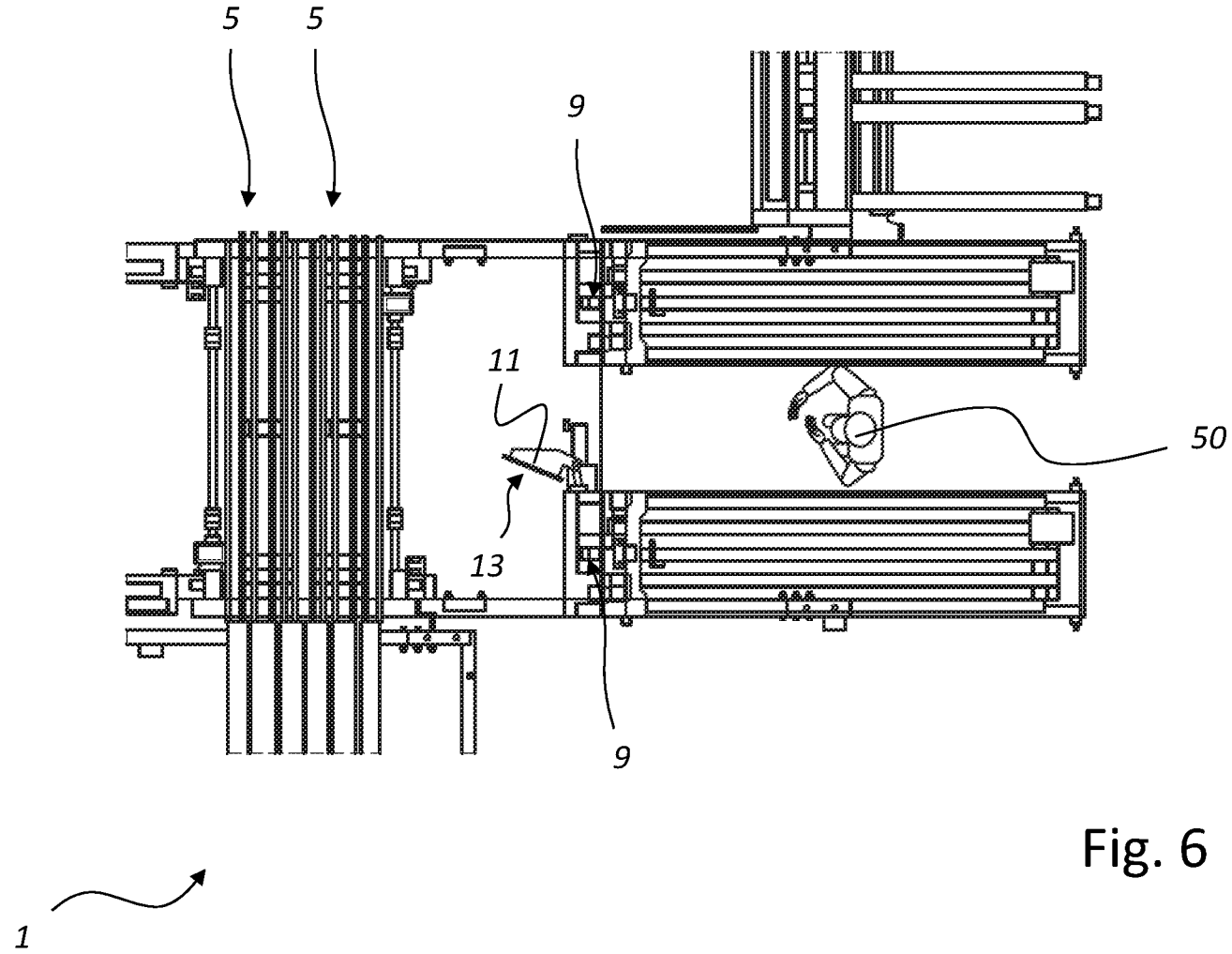
FIG. 6 shows a schematic top view of a second embodiment of an inventive apparatus.

FIG. 6 shows a schematic top view of a second embodiment of an inventive apparatus 1. According to the embodiment from FIG. 5, the apparatus 1 of the embodiment from FIG. 6 has two parallel transport paths 5 for outer packagings.

In addition, the embodiment from FIG. 6 includes two provisions 9 for a respective stock 8 (see FIGS. 1 to 4) of compartments 3. The provisions 9 are arranged adjacent to each other, wherein only the lower provision 9 of the provisions 9 has a working arm 11 with a broadside surface 13, which can receive compartments 3 from the stock 8 of the lower provision 9 and transfer them into a waiting position via a swiveling movement as described for FIGS. 1 to 4. By the two provisions 9 and the receipt and transfer of a compartment 3 into a waiting position by the working arm 11, three compartments 3 can be presented for one clocking cycle by only two provisions 9 and/or two stocks 8 and placed in three outer packagings.

Figure 7:
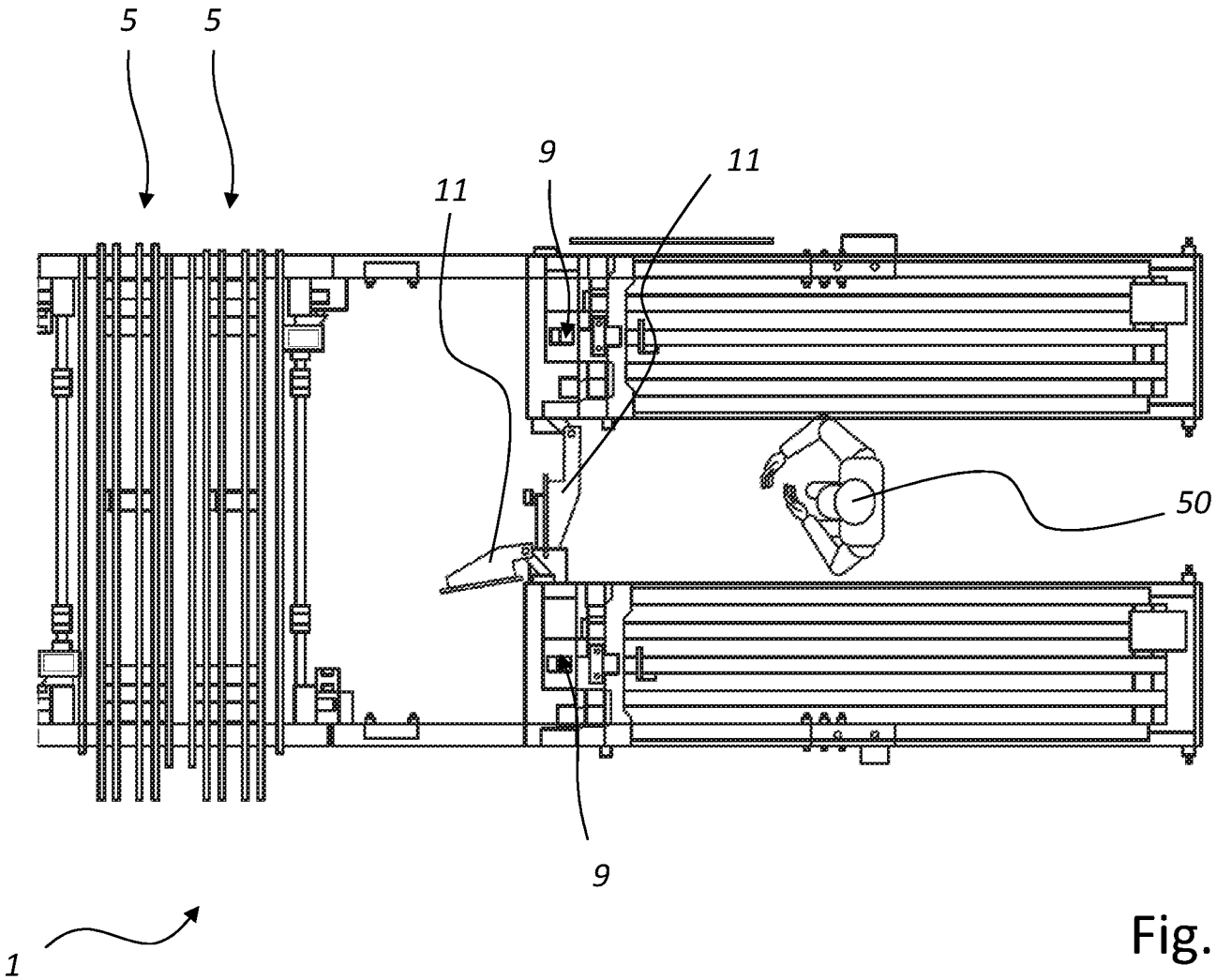
FIG. 7 shows a schematic top view of a third embodiment of an inventive apparatus.

FIG. 7 shows a schematic top view of a third embodiment of an inventive apparatus 1. According to the embodiment of an apparatus 1 from FIG. 6, the embodiment of an apparatus 1 from FIG. 7 has two transport paths 5 oriented parallel to each other. Furthermore, two provisions 9 and/or two specific provisions 9 can be seen, by which in each instance a stock 8 of compartments 3 (see FIGS. 1 to 4) can be presented. Each of the provisions 9 is assigned a working arm 11 with a respective broadside area 13, which respective working arm 11 can receive compartments 3 of the respective provision 9 and transfer them into a waiting position according to the previous description of the FIGS. 1 to 4.

Since the compartment 3 in the previous embodiment from FIG. 6 for a respective clock cycle is received by the lower provision 9 with double the number as compared to the upper provision 9, in the embodiment from FIG. 6 an exchange of the stock 8 for the lower provision 9 often has to be carried out in order to be able to present a sufficient number of compartments 3 throughout.

Advantageously, in the embodiment from FIG. 7, a respective compartment 3 is transferred alternately for successive clock cycles via the working arm 11 of the upper provision 9 and the working arm 11 of the lower provision to a respective waiting position in accordance with the previous description of FIGS. 1 to 4. If new stocks 8 of compartments 3 brought into the provisions 9 have an identical number of compartments 3, these are used up at the same time and then replaced. An alternating swiveling of the working arms 11 can be specified by a control unit not shown in the figures of this patent application, which control unit controls respective servo motors connected to the working arms 11. A working tool, which is not shown in FIG. 7, can be controlled via the control unit for the alternating receipt of a respective compartment 3 via the two working arms 11.

Figure 8:
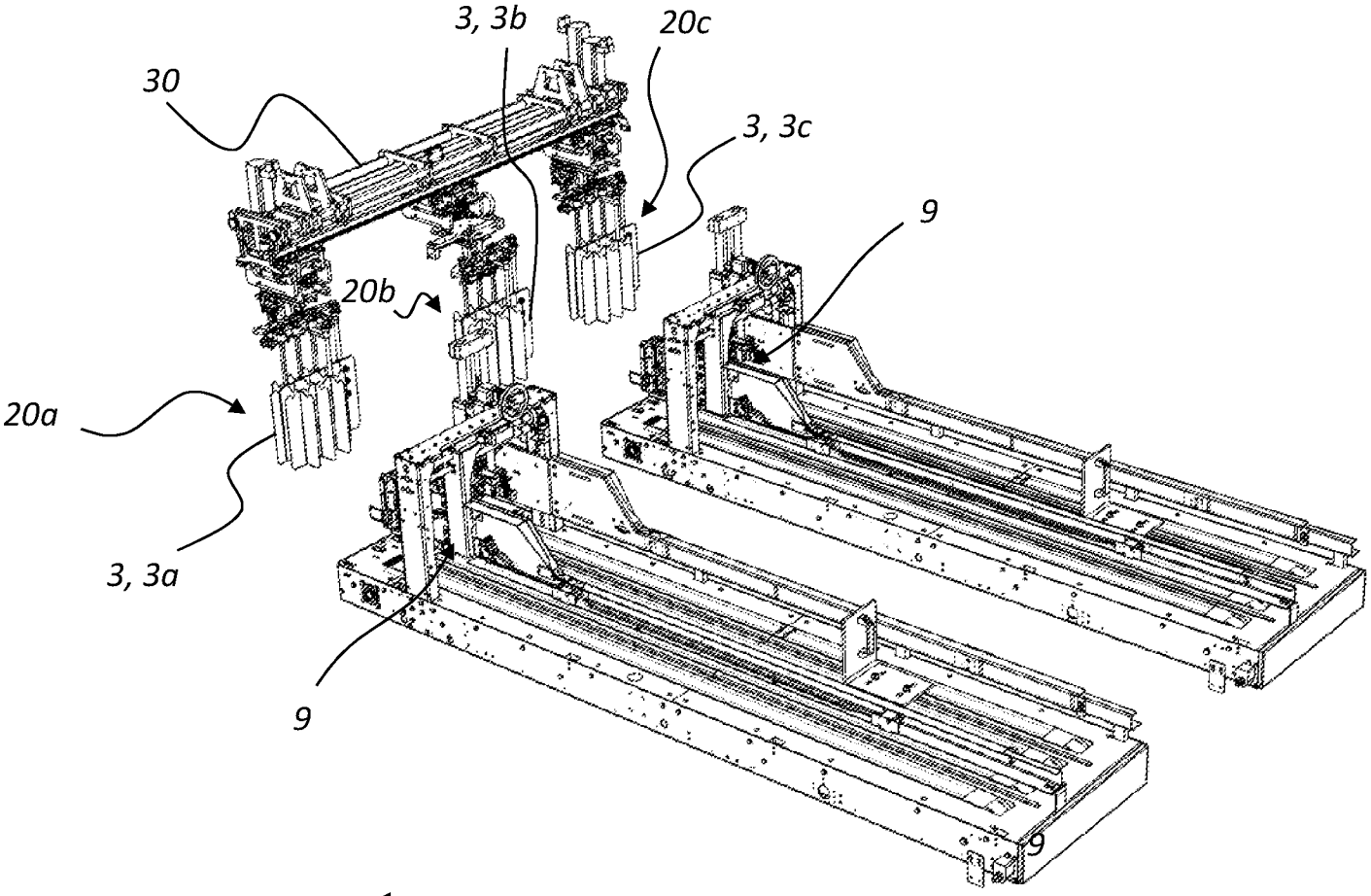
FIG. 8 shows a schematic perspective view of a fourth embodiment of an inventive apparatus.

FIG. 8 shows a schematic perspective view of a fourth embodiment of an inventive apparatus 1. The embodiment from FIG. 8 includes two provisions 9, each of which has received a stock 8 of compartments 3 (see FIGS. 1 to 4).

Furthermore, the apparatus 1 from the embodiment from FIG. 8 comprises a first suction and/or gripping instrument 20*a*, a second suction and/or gripping instrument 20*b* and a third suction and/or gripping instrument 20*c*. The first suction and/or gripping instrument 20*a*, the second suction and/or gripping instrument 20*b* and the third suction and/or gripping instrument 20*c* are carried by a joint suspension or working system 30 and/or are fastened to a joint suspension 30 and can be moved back and forth between the provisions 9 and the transport paths 5 not shown in FIG. 8 via the suspension 30.

In the embodiment from FIG. 8, the suspension 30, together with the first suction and/or gripping instrument 20*a*, the second suction and/or gripping instrument 20*b* and the third suction and/or gripping instrument 20*c*, is moved in the direction of the provisions 9 until the second suction and/or gripping instrument 20*b* comes into abutment with a frontmost compartment 3 of the stock 8 of the lower provision 9 and pneumatically grips the frontmost compartment 3 of the lower provision 9. The second suction and/or gripping instrument 20*b* can be moved relative to the first suction and/or gripping instrument 20*a* and relative to the third suction and/or gripping instrument 20*c*. On removal or contact of the second suction and/or gripping instrument 20*b* with the frontmost compartment 3 of the lower provision 9, the second suction and/or gripping instrument 20*b* has an orientation in which the second suction and/or gripping instrument 20*b* aligns at least partially with the first suction and/or gripping instrument 20*a*.

Temporally after removal of a frontmost compartment 3 and/or second compartment 3*b* of the lower provision 9 via the second suction and/or gripping instrument 20*b*, the entire suspension 30 together with the first suction and/or gripping instrument 20*a*, the second suction and/or gripping instrument 20*b* and the third suction and/or gripping instrument 20*c* is moved away from the provisions 9.

In addition, the second suction and/or gripping instrument 20*b* is moved along the suspension 30 relative to the first suction and/or gripping instrument 20*a* and relative to the third suction and/or gripping instrument 20*c* until the second suction and/or gripping instrument is located at least approximately centrally between the first suction and/or gripping instrument 20*a* and the third suction and/or gripping instrument 20*c* as shown in FIG. 8.

Subsequent in time, the suspension 30, together with the first suction and/or gripping instrument 20*a*, the second suction and/or gripping instrument 20*b* and the third suction and/or gripping instrument 20*c*, moves again in the direction of the provisions 9, wherein the first suction and/or gripping instrument 20*a* comes into abutment with a frontmost compartment 3 of the lower provision 9 and the third suction and/or gripping instrument 20*c* comes into abutment with a frontmost compartment 3 of the upper provision 9. The frontmost compartments 3 and/or the first compartment 3*a* and the third compartment 3*c* are then pneumatically gripped by the first suction and/or gripping instrument 20*a* and the third suction and/or gripping instrument 20*c*, whereupon the suspension 30 together with the first suction and/or gripping instrument 20*a*, the second suction and/or gripping instrument 20*b* and the third suction and/or gripping instrument 20*c* are moved away from the provisions 9 and in the direction of the transport paths 5 shown in FIGS. 5 to 7, which transport paths 5 transport a plurality of outer packagings.

The first suction and/or gripping instrument 20*a*, the second suction and/or gripping instrument 20*b* and the third suction and/or gripping instrument 20*c* unfold the removed first compartment 3*a*, the removed second compartment 3*b* and the removed third compartment 3*c* temporally during their movement in the direction of the transport paths 5. Subsequently, the first compartment 3*a*, the second compartment 3*b* and the third compartment 3*c* are inserted by the first suction and/or gripping instrument 20*a*, the second suction and/or gripping instrument 20*b* and the third suction and/or gripping instrument 20*c* into respectively associated outer packagings, which are moved along the transport paths 5. For this purpose, the first suction and/or gripping instrument 20*a*, the second suction and/or gripping instrument 20*b* and the third suction and/or gripping instrument 20*c* can be lowered in a perpendicular direction relative to the suspension 30.

Since from the lower provision 9 and/or from the stock 8 (see FIGS. 1 to 4) of the lower provision 9 two compartments 3 arranged frontmost were taken for one clocking, whereas for this respective clocking only one compartment 3 arranged frontmost was taken from the upper provision 9 and/or the upper stock 8, the stock 8 of compartments 3 of the lower provision 9 would be exhausted at an earlier time for continuous clocking. To avoid this problem, it is therefore provided that the second suction and/or gripping instrument 20*b* alternately removes compartments 3 from the stock 8 of the lower provision 9 and from the stock 8 of the upper provision 9 in successive clocking cycles.

For reasons of completeness, it should also be mentioned that the compartments 3 are each presented standing and/or in an upright orientation via the upper provision 9 and the lower provision 9. The compartments 3 can therefore be removed via the first suction and/or gripping instrument 20*a*, the second suction and/or gripping instrument 20*b* or the third suction and/or gripping instrument 20*c* and then inserted directly into the respective outer packagings, wherein it is not necessary to rotate or align the removed compartments 3 until they are completely inserted into their respective outer packaging. Furthermore, practice has shown that compartments 3 can bend in a horizontal arrangement in the respective provision 9, which may lead to problems with the removal of compartments 3. Such problems can be counteracted by the upright or standing orientation according to the embodiment described.

The invention was described with reference to a preferred embodiment. However, it is conceivable for an expert that modifications or alterations of the invention can be made without leaving the scope of protection of the following claims.

LIST OF REFERENCE SIGNS

1 Apparatus
3 Compartment

3*a* First compartment
3*b* Second compartment
5 Transport path
7 Working arm
8 Stock
9 Provision
11 Working arm
13 Broadside surface
20*a* First suction and/or gripping instrument
20*b* Second suction and/or gripping instrument
20*c* Third suction and/or gripping instrument
30 Suspension or working system
50 Operator

The invention claimed is:

1. An apparatus (1) for transferring compartments (3) to outer packagings provided for articles, comprising:

at least one stock (8) of compartments (3), at least one transport path (5) for outer packagings; and a working system that removes at least two compartments (3) from the at least one stock (8), that moves the at least two compartments (3) from the at least one stock (8) in a temporally overlapping manner in a direction of the at least one transport path (5), and that inserts each of the at least two compartments (3) removed from the at least one stock (8) simultaneously into immediately succeeding or immediately adjacent outer packagings.

2. The apparatus of claim 1, wherein the at least one stock (8) holds the at least two compartments (3) in an upright orientation.

3. The apparatus of claim 2, wherein the working system comprises:

at least one working arm (11) that receives and moves at least one first compartment (3*a*) from the at least one stock (8) into a waiting position, and wherein the working system moves, in a temporally overlapping manner with the movement of the at least one first compartment, at least one second compartment (3*b*) in a direction of the outer packagings and inserts the at least one first compartment (3*a*) and the at least one second compartment (3*b*) into respective outer packagings.

4. The apparatus of claim 3, wherein the at least one working arm (11) pivots about a perpendicularly oriented axis.

5. The apparatus of claim 1, wherein the working system comprises a first suction or gripping instrument (20*a*) and a second suction or gripping instrument (20*b*), wherein the first suction or gripping instrument (20*a*) removes a first compartment (3*a*) from the at least one stock (8), wherein the second suction or gripping instrument (20*b*) removes a second compartment from the at least one stock (8), and wherein the first suction or gripping instrument (20*a*) and the second suction or gripping instrument (20*b*), together with the removed first and second compartments (3*a*, 3*b*), in a temporally overlapping manner, move in a direction of the outer packagings and insert the first and second compartments (3*a*, 3*b*) into respective outer packagings.

6. The apparatus of claim 5, wherein the working system further comprises a third suction or gripping instrument (20*c*), wherein the third suction or gripping instrument (20*c*) removes a third compartment (3*c*) from the at least one stock (8), and wherein the third suction or gripping instrument (20*c*), the second suction or gripping instrument (20*b*), and the first suction or gripping instrument (20*a*), together with the removed first, second and third compartments (3*a*, 3*b*, 3*c*), in a temporally overlapping manner, move in the direction of the outer packagings and insert the first, second and third compartments (3*a*, 3*b*, 3*c*) into respective outer packagings.

7. The apparatus of claim 6, wherein the second suction and/or gripping instrument (20*b*) and the third suction or gripping instrument (20*c*) remove the second and third compartments (3*b*, 3*c*) in a time-synchronous manner.

8. The apparatus of claim 6, wherein the first suction or gripping instrument (20*a*) and the third suction or gripping instrument (20*c*) remove the first and third compartments (3*a*, 3*c*) simultaneously.

9. The apparatus of claim 1, wherein the at least one stock (8) comprises at least a lower provision and an upper provision.

10. The apparatus of claim 9, wherein the working system comprises a first suction or gripping instrument (20*a*), a second suction or gripping instrument (20*b*), and a third suction or gripping instrument (20*c*), wherein the first suction or gripping instrument (20*a*) removes a first compartment (3*a*) from the lower provision, the third suction or gripping instrument (20*c*) removes a third compartment (3*c*) from the upper provision, and the second suction or gripping instrument (20*b*) removes a second compartment from the lower or upper provision, and wherein the third suction or gripping instrument (20*c*), the second suction or gripping instrument (20*b*), and the first suction or gripping instrument (20*a*), together with the removed first, second and third compartments (3*a*, 3*b*, 3*c*), in a temporally overlapping manner, move in a direction of the outer packagings and insert the first, second and third compartments (3*a*, 3*b*, 3*c*) into respective outer packagings.

11. The apparatus of claim 10, wherein, in successive clocking cycles, the second suction or gripping instrument (20*b*) alternately removes the second compartment (3*b*) from the lower provision and upper provision.

* * * * *